US007410541B2

(12) United States Patent
Boyd et al.

(10) Patent No.: US 7,410,541 B2
(45) Date of Patent: Aug. 12, 2008

(54) ROLL COATER ASSEMBLY SYSTEM

(75) Inventors: Thomas J. Boyd, Akron, OH (US); Kathleen C. Boyd, Akron, OH (US); Robert L. Brown, Hartville, OH (US)

(73) Assignee: VMI Epe Holland BV, Epe (NL)

( * ) Notice: Subject to any disclaimer, the term of this patent is extended or adjusted under 35 U.S.C. 154(b) by 0 days.

(21) Appl. No.: 11/280,972

(22) Filed: Nov. 15, 2005

(65) Prior Publication Data

US 2006/0130973 A1 Jun. 22, 2006

Related U.S. Application Data

(60) Provisional application No. 60/627,990, filed on Nov. 15, 2004.

(51) Int. Cl.
*B05C 11/10* (2006.01)

(52) U.S. Cl. ..... 118/670; 118/696; 118/697; 118/712

(58) Field of Classification Search ..... 118/670, 118/696, 697, 712
See application file for complete search history.

(56) References Cited

U.S. PATENT DOCUMENTS

| | | | | |
|---|---|---|---|---|
| 5,183,509 | A | 2/1993 | Brown et al. | |
| 5,275,664 | A | 1/1994 | Brown et al. | |
| 6,958,170 | B2 * | 10/2005 | Benaglio et al. | 427/8 |
| 2006/0130973 | A1 * | 6/2006 | Boyd et al. | 156/363 |

* cited by examiner

*Primary Examiner*—George Koch

(57) ABSTRACT

A roll coater assembly system for application of a fluid material having a transport system with a part loading system, an application system, and a curing system for curing the material applied. The transport system is a continuous conveyor having a plurality of work stations movably supporting and transporting items to be processed to the application systems and curing systems, with the conveyors of the transport and loading systems having a single drive mechanism which operates both of the conveyors, such that the cylindrical items are provided to circumferentially located stations within and surrounding a cylindrical wheel of the part loading system which rotates to engage and move the cylindrical items into and out of the stations of the cylindrical wheel about a central axis of the cylindrical wheel and into the transport system conveyor by movement of the drive mechanism and respective conveyor synchronized by a control system.

6 Claims, 12 Drawing Sheets

36
37
38
A
A

ROLL COATER ASSEMBLY SYSTEM

CROSS-REFERENCE TO RELATED APPLICATIONS

The present application claims priority from U.S. Patent Application Ser. No. 60/627,990 filed Nov. 15, 2004, the entire subject matter of which is incorporated herein by reference.

BACKGROUND OF THE INVENTION

1. Field of Invention

The present invention relates to an improved manufacturing assembly system and more specifically for an improved automated assembly system for roll coating or otherwise preparing manufactured products for further manufacture and shipping.

2. Background of the Related Art

In the past, manufacturing assembly systems have required a variety of human intervention to complete the manufacture of a part, and may have resulted in poor part quality. Consistent, continuous and unassisted feeding of such parts to the manufacturing system can be difficult to maintain. Additionally, manufacturing systems which apply coatings to parts often apply such coatings using a spray system. Spray coating systems have the disadvantage that they are inefficient. During the spray application of material, a majority of the material being sprayed may be "lost," or never applied to the part to be coated.

While such material losses may be expensive, they may also result in releases of solvents or volatile organic component materials into the environment. Since such materials should not be released into the environment, prior systems may have required additional expense to reclaim such "lost" materials. Reclamation systems are typically expensive to operate, and may also result in additional waste treatment issues, for example, waste water removed from the reclamation system. Examples of prior art systems are found in U.S. Pat. Nos. 5,183,509 and 5,275,664, the subject matter of which are incorporated herein by reference.

The present system, in addition to providing improved product quality, provides an improved system for accurate and continuous feeding of parts. The present system also reduces system down time due to changes in manufacturing and part requirements, to provide manufacturing process flexibility.

SUMMARY OF THE INVENTION

The present manufacturing assembly system is a modular design, and may include: an infeed assembly conveyor module having a step feeder system; and a transfer assembly module for moving parts being manufactured between the infeed assembly module and roll coating assembly modules.

The roll coating assembly module may include a variety of part processing procedures, such as preheating, a first coating application or primer application and heating, a second coating application or adhesive application, and a third coating application or second adhesive application. A return conveyor system is also provided which enables cooling of the manufactured parts being coated and return to a finished part conveyor.

The present manufacturing system is a substantially closed system which enables the use of an internal negative pressure environment surrounding the system. The sealed system enables the monitoring and control of solvents within the system, which also monitors viscosity of the coatings being applied. The condition of the materials or coatings is also monitored by the viscosity monitoring system which confirms that the materials applied are maintained within the desired conditions. Quality checking of the completed products is provided using various electronic eye sensors located outside the system. The system provides flexibility to the manufacturing process, since the modules may be added, changed or removed as needed.

The roll coating assembly module includes a roller/applicator assembly unit, or a moveable application unit, which is a vertical cart member mounted on rollers which supports the desired primer, adhesives or other coating supplies to be applied using the system. The roller/application assembly additionally supports system assemblies used within the sealed system. Specifically, the cart is rolled into sealed engagement with a base member of the system, so that the roller applicators are in communication with system supply units, which supply the materials or coatings to be applied to the parts being manufactured.

A novel part loader assembly is also provided. The part loader enables continuous loading of parts without the requirement to stop the system operation for part loading. The part loader uses a cylindrical wheel with openings provided for rotating the parts into the wheel, and onto a further conveyor for processing.

A vision system is used to notify the system if parts are feed properly or not. In the event no parts are feed, a clutch is operated to maintain the wheel in position until parts are provided. The drive belt for the part loader is the same as the belt drive for the conveyor, so the parts are always provided to the loader at the same speed as they are loaded. Additionally, multiple parts may be provided to the same slots within the part loader wheel.

Parts are removed from the system using a ski system which drives the parts off their conveyor pins onto a waiting removal or return conveyor system. A dual removal system is provided so that once a take away tote or other removal container is filled, the parts are provided to an alternate container until the full take away container is replaced with an empty container. The vision system also provides that improperly coated parts are automatically rejected.

Other features and advantages of the present manufacturing assembly system will become apparent from the following detailed description of the preferred embodiments made with reference to the accompanying drawings, which form a part of the specification.

DETAILED DESCRIPTION OF THE DRAWINGS

Figure 1:
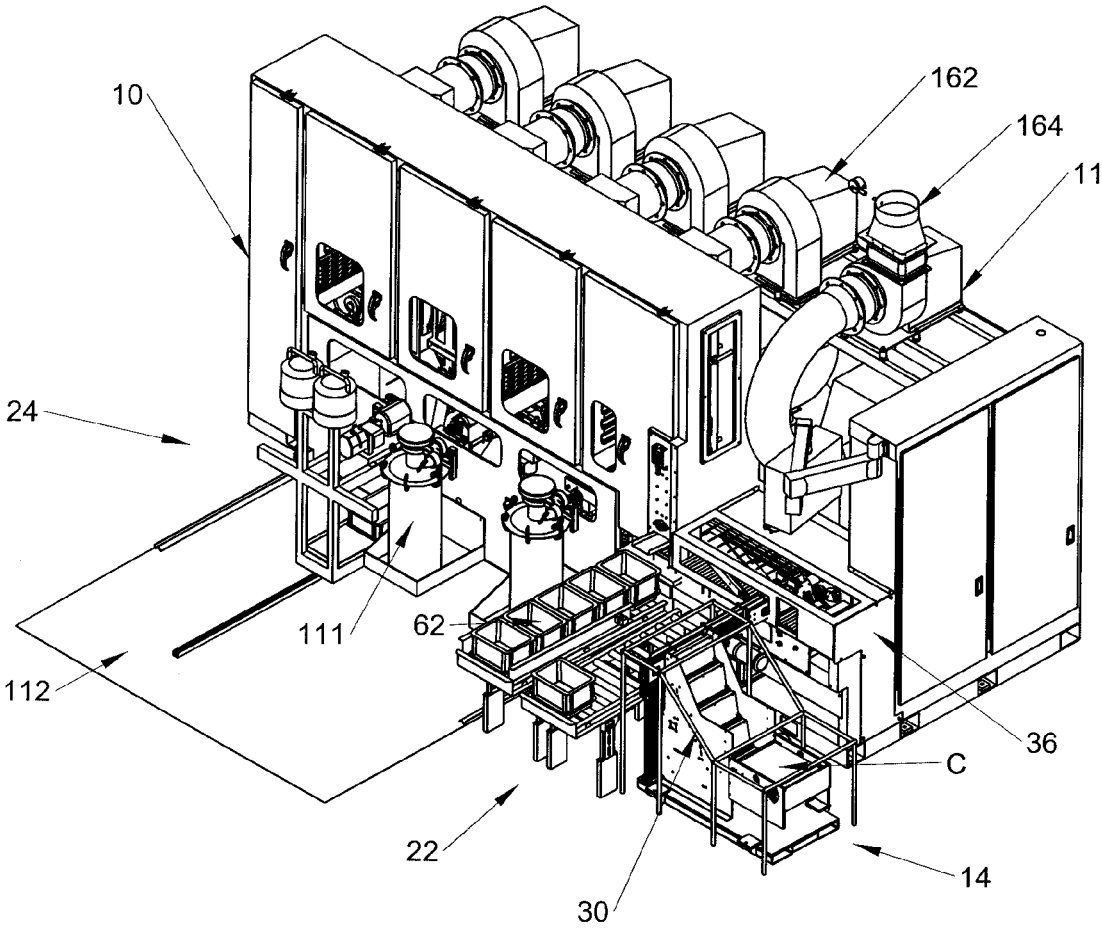
FIG. 1 illustrates a schematic partial perspective view of a manufacturing assembly system for applying material cylindrical items of manufacture in accordance with the present application.
Figure 2:
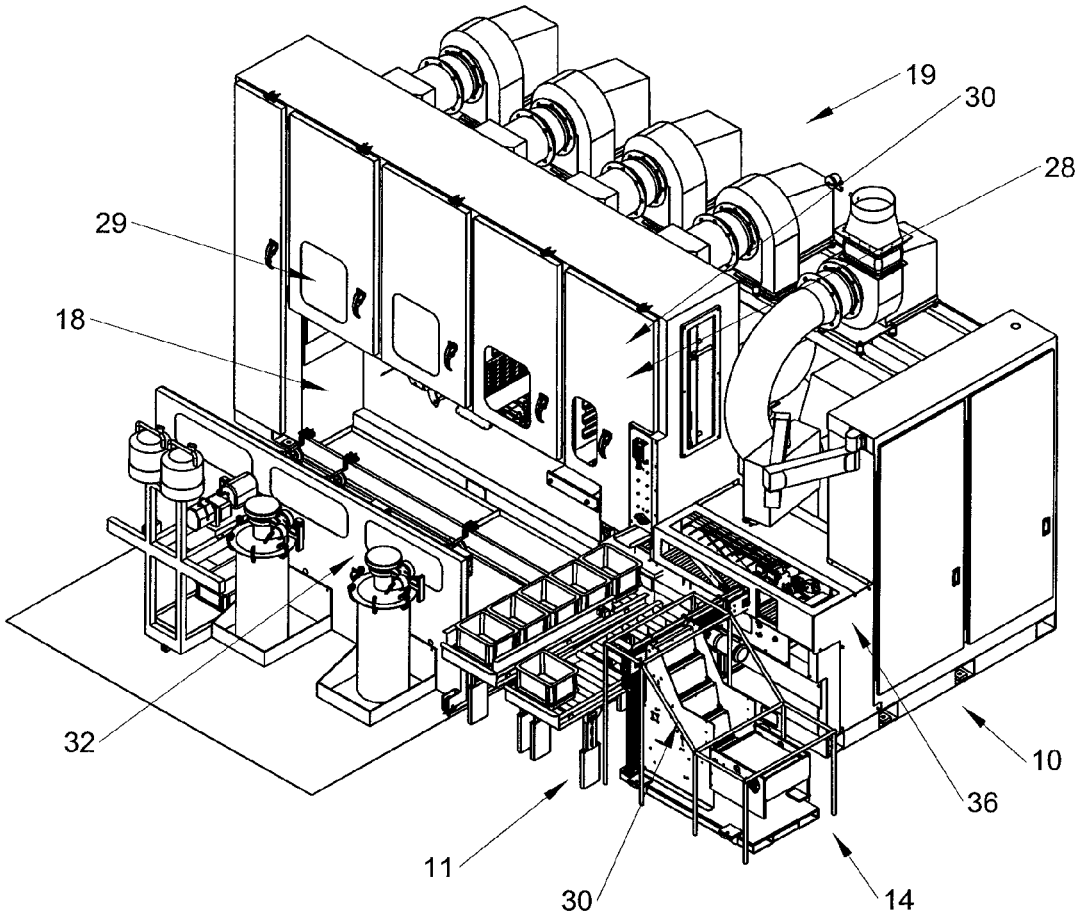
FIG. 2 illustrates the schematic partial perspective view of FIG. 1, with but with the roll coating assembly modules and material supply system module moved away from a conveyor module for moving the parts through the system.
Figure 3A:
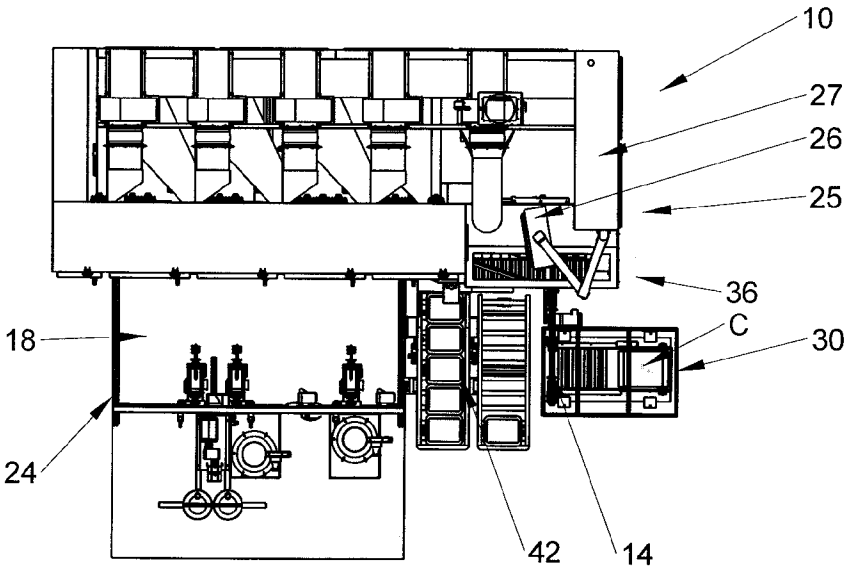
FIGS. 3A, 3B and 3C are, respectively, a schematic partial top view, side view and front view of the system illustrated in FIG. 1.
Figure 3B:
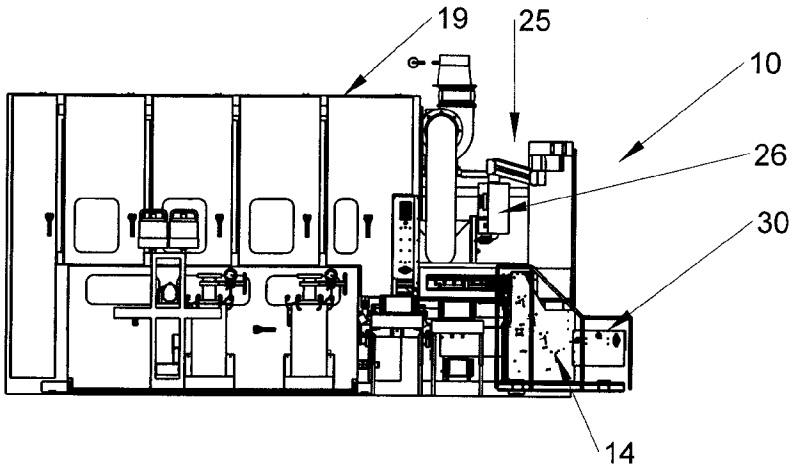
Figure 3C:
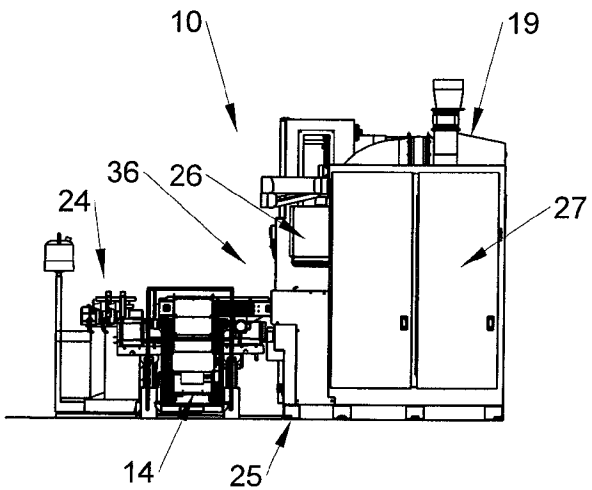
Figure 4B:
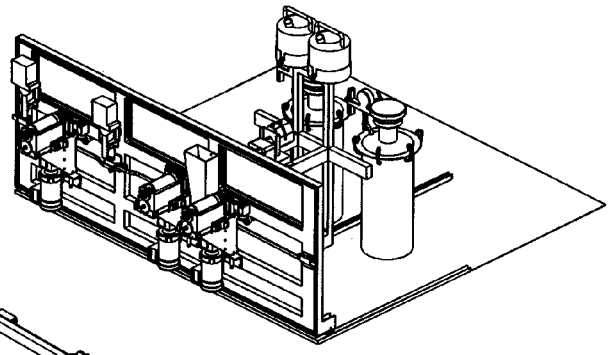
FIGS. 4A and 4B are, respectively, a schematic perspective right side view and left side view of the material supply system module and the roll coating assembly modules in accordance with the present application.
Figure 4A:
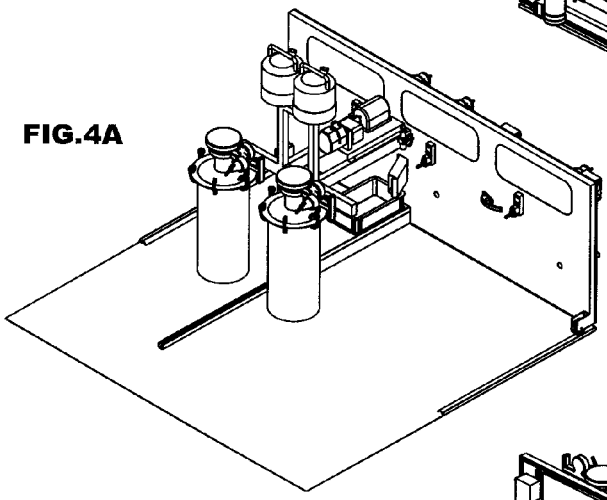
Figure 4D:
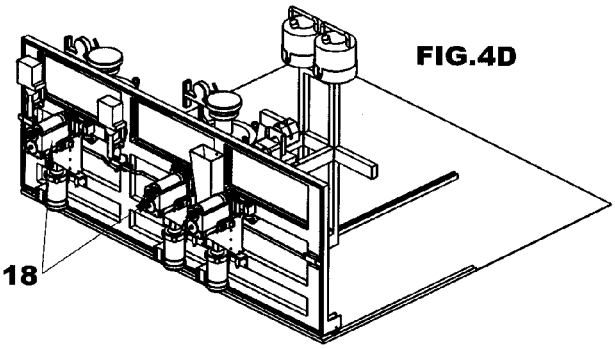
FIGS. 4C and 4D are schematic perspective right side views and left side views of alternate embodiments of the material supply system module and roll coating assembly modules shown in FIGS. 4A and 4B.
Figure 4C:
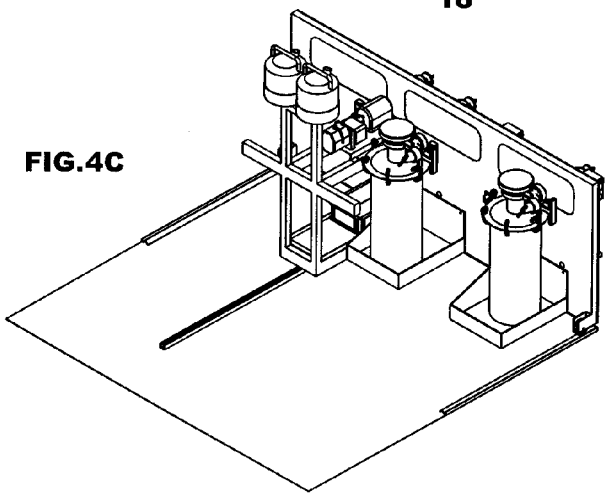

Turning now to the illustrations of the present embodiments, a multi-station manufacturing assembly system 10, shown in FIGS. 1 through 3D, provides flexibility in the manufacturing processes to be used in connection with completion of the items to be manufactured C. The system 10 is supported on a modular frame 11 and includes work stations positioned along conveyors continuously feeding items C to be manufactured.

All system operations are automatic and controlled by an Allen Bradley programmable logic controller, such as an SLC 5/05 PLC. Additionally, the system is programmed using Allen Bradley RS Logix 500 software, as well as a variety of other Allen Bradley system controllers, for example, IEC style pushbutton switches, and Guard Master safety relays and emergency stop buttons, as well as other conventional controllers, all of which are well known to one of ordinary skill in the art and are collectively referred to herein as the central control system 25. Operation of the central control system 25 and its numerous controller, drive, sensor and switch components are provided at an operator interface terminal 26, such as a Parker Automation CTC PS10 color touch, which is illustrated in FIG. 1 on a control arm which enables the terminal to clear all equipment and secondary equipment for positioning as desired by an operator.

Certain environmental, electrical and valve components of the central control system 25 are provided within cabinets 27 located within the modular frame 11 as shown. The improved cabinets 27 are fully insulated and include insulated doors upon which electrical components may be mounted, and which also enable ready access to the controls for repair and cleaning. Additional system units may also be secured to the modular frame, and preferably at corner locations such that ready access to the units is provided upon removal of the adjacent doors or safety panels. Likewise, electrical connections are provided adjacent frame openings and connections are preferably quick disconnect type components to permit quick change out of modular system components.

FIG. 1 illustrates the manufacturing assembly system 10 as a roll coater assembly for applying coating material(s) to the external diameters of cylindrical items C having at least one open end. The system 10 supports a part supply system 14 and a transport or transfer system 16 for moving parts being manufactured through the system 10. Also provided are roll coating or application modules 18, a material supply system module 24 which supplies the material(s) to be coated to the roll coating modules 18, a curing system 19 for curing the material M applied to the cylindrical items C, and a take-away or removal system 22 for removing the completed cylindrical items. The control system 25 controls position and movement of the cylindrical items through the system 10 at desired locations and specified speeds. The frame 11 comprises metal support members for supporting and defining the transport system 16, material supply system module 24, roll coater assembly modules 18 and curing systems 19.

It should be understood that the embodiment of the system 10 illustrated includes multiple application systems 18 and curing systems 19 for applying coating materials at numerous stations. In a first station 30, the items C may be preheated or otherwise prepared for later stations. At a second station 32, a first coating material or primer material may be applied to the items. The items then proceed on the transport system 19 to a first curing process, and exit to a second and/or third application system 32, 34, 35 where a secondary and/or any finish material is applied to the items. The items then proceed to a second and/or third curing system, before exiting to the take-away or finished part conveyor system 42. Single application and curing systems may be used, or multiple combinations of application and curing systems may be used to complete manufacture of the desired cylindrical items. As the first, second and third application systems, and associated curing systems are substantially similar, each of the systems will be referred with a prime designation, with only certain differences highlighted between the systems in further detail.

As shown in FIGS. 1, 2, 7 and 8, the transport, application and curing systems 16, 18, 19 are supported on the frame 11 enclosed within walls and hinged doors or covers 28, which are also supported on the frame 11. The use of walls and doors 28 with openings permits the operator to view the system 10 during operation, while preventing exposure to the system's moving parts, or fumes from material application. The openings 29 in walls and covers 28 are sealed using a clear synthetic resin material, for example Tempered Glass.

Cover or door interlock switches are positioned adjacent each hinged cover 28, and are electrically interconnected to the control system 25. In the event the covers 28 are manually opened during operation of the system 10, the interlock switches operate to halt operation. Such safety interlocks ensure that the operator cannot access the system during operation.

A preferred part supply system 14 of the present invention is best illustrated in FIGS. 9 to 11 and FIGS. 1 to 3. The part supply system 14 includes a conventional step feeder system 30. As shown in FIG. 1C, the step feeder system 30 is supported adjacent the frame 11 of the system 10. Cylindrical items C are supplied to a loading container of the step feeder system 30, and moved by a part loading system 36 of the part supply system 14.

Figures 9A, 9B:
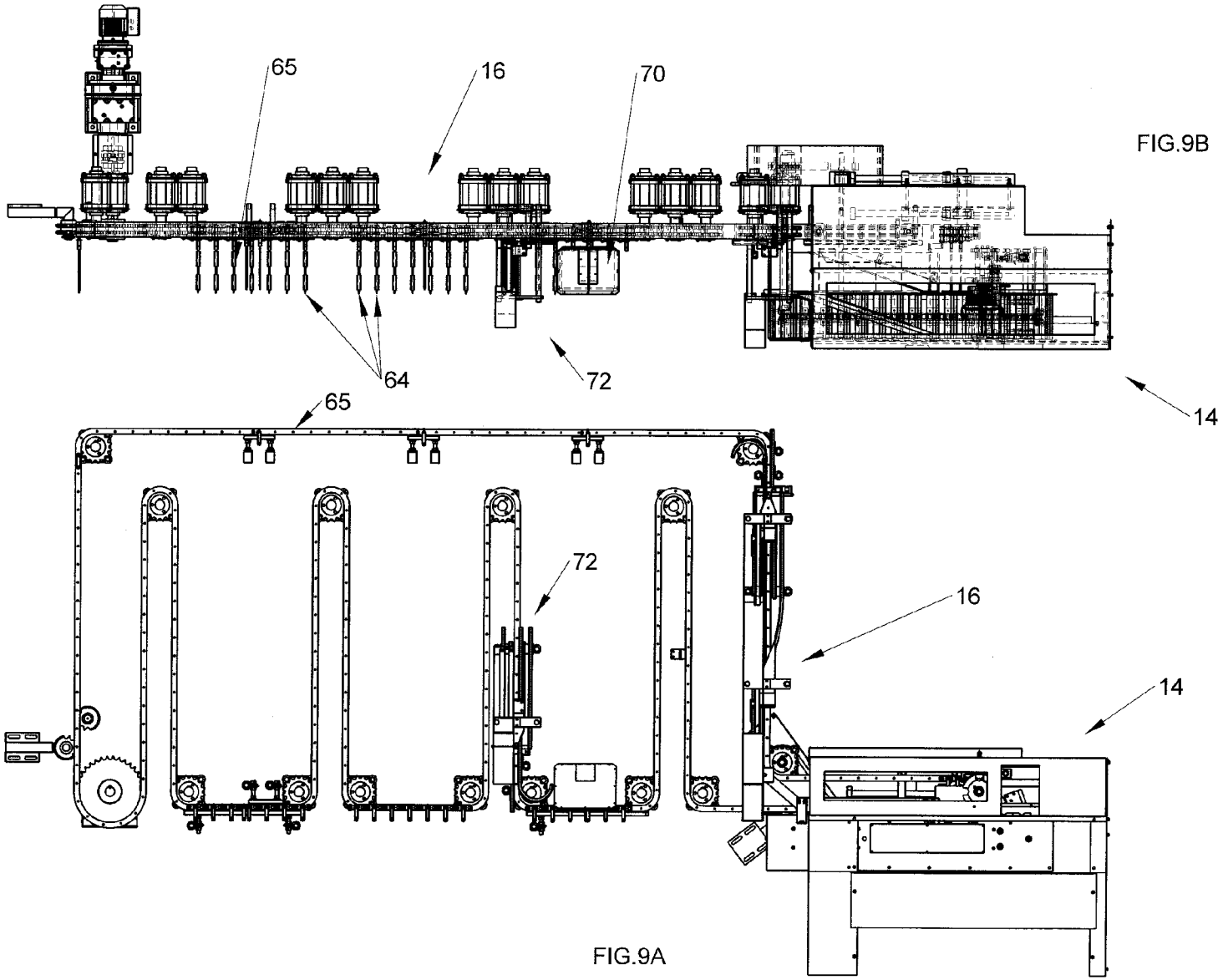
FIGS. 9A and 9B illustrate, respectively, schematic front and top views of the transport or transfer assembly system.
Figures 10A, 10B, 10C, 10D, 10E, 10F:
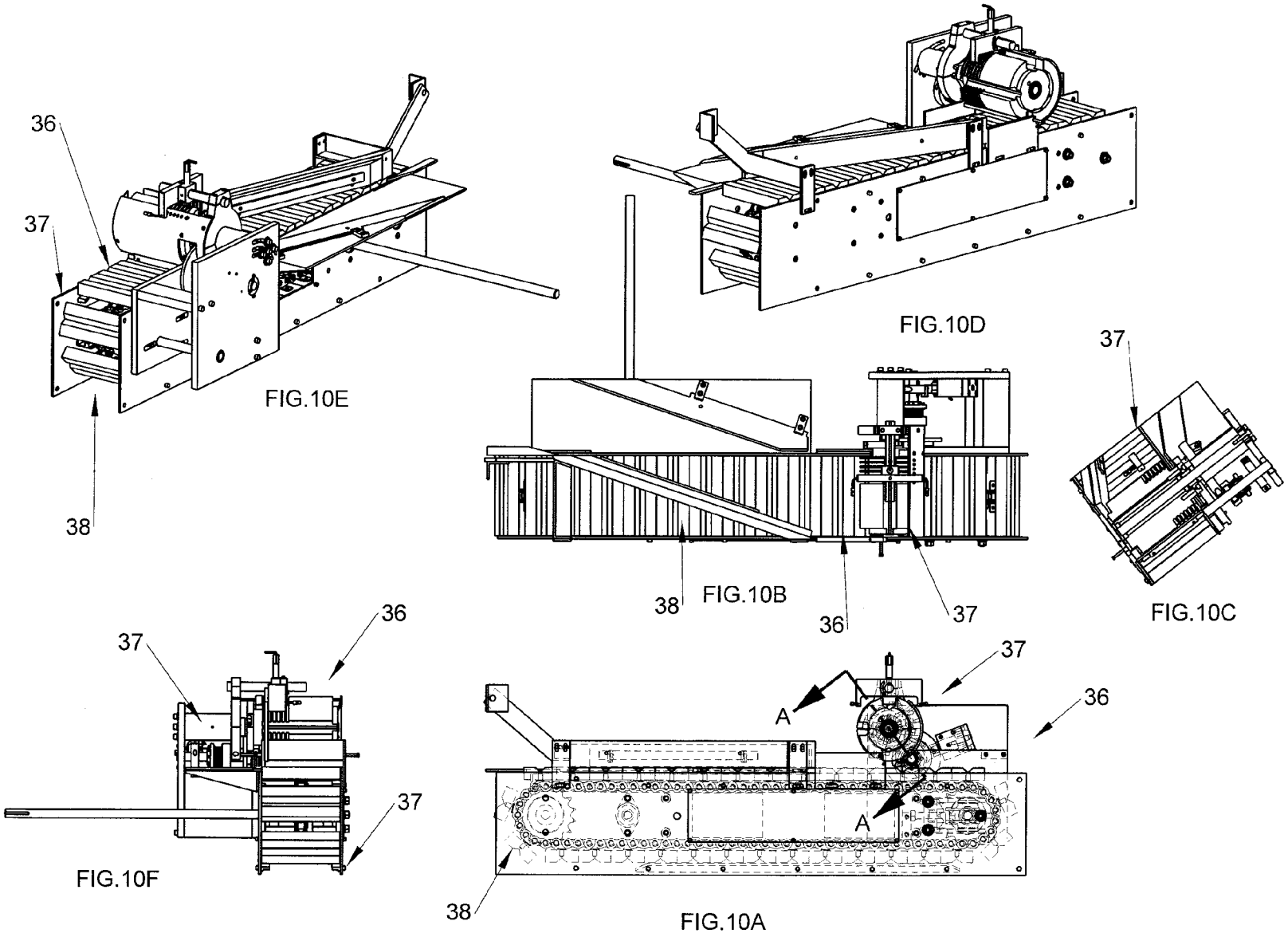
FIGS. 10A to 10F illustrate, respectively, a schematic side, cut-away along line A-A, perspective side, perspective back side, and end views of the part loading system and part loading assembly.
Figure 11:
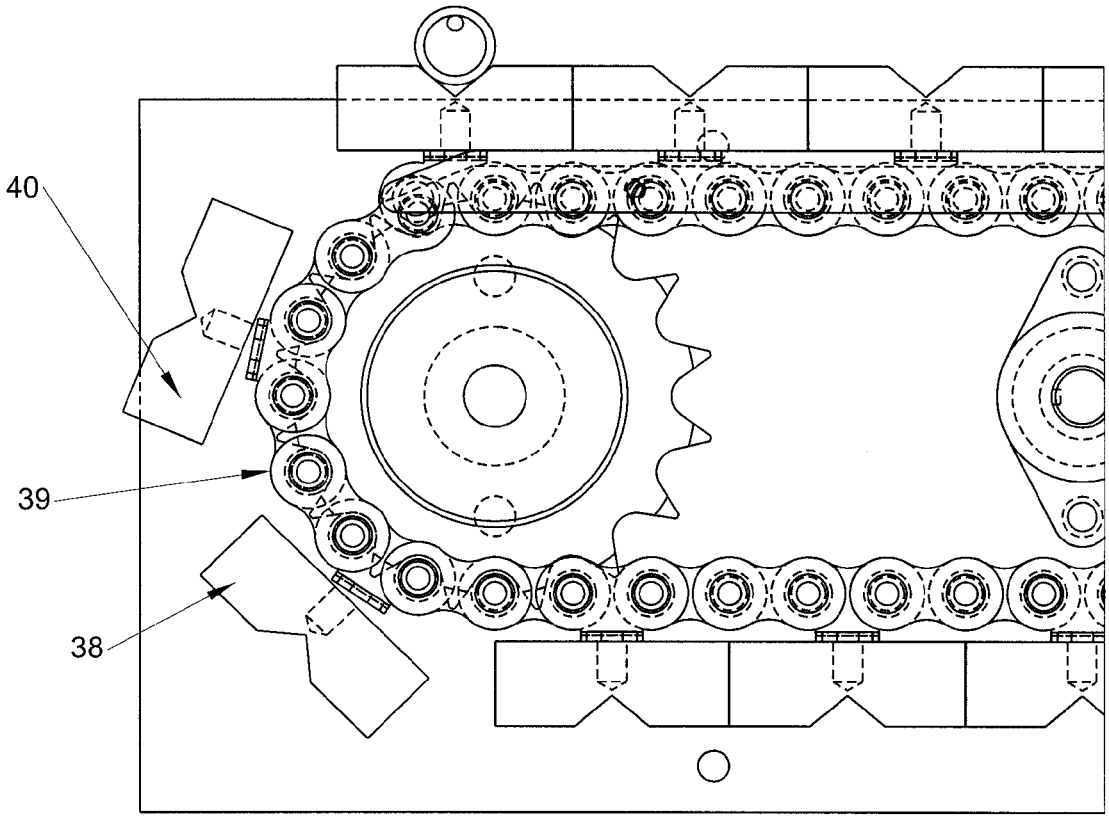
FIG. 11 is a schematic cut-away side view of the part loading system and pin assembly engaged with an item to be manufactured, which is shown schematically in two different sizes, with the pin assembly adjusted to accommodate the item.

The part loading system 36 of the present invention is illustrated in most detail in FIGS. 9A through 10F and provides the cylindrical items C to the transport system 16. As shown in FIGS. 9A and 10A, the loading system 36 includes a main body 37 which is supported on the system frame 11. The main body 37 supports a conventional continuous v-block conveyor system 38 which transports the cylindrical items C to the transport system 16. As shown in FIG. 11, the conveyor system 38 includes a continuous chain 39 having v-shaped blocks 40 for supporting the items C. The v-blocks 40 are secured to the chain 39 which engages conventional first and second sprockets which are rotated by a drive shaft supported on flange bearings. The shaft and sprockets are driven by a main drive mechanism which operates the conveyors of both the loading system 36 and the transport system 16 as shown in FIG. 9A.

In the embodiment illustrated, the main drive mechanism includes a conventional gear motor. The conventional drive shaft and sprockets are interconnected with the main drive mechanism by a series of chain drives as shown schematically in the illustrations. Operation of a single main drive mechanism enables synchronized movement to be maintained as the cylindrical items C move through the system 10.

As schematically illustrated in FIG. 9B, the transport or transfer system 16 for moving the items C through the system 10 is a continuous chain, pin-type conveyor system having multiple pin assembly stations 64 supporting the cylindrical items C on an internal surface, as described herein. Multiple drive and take-up sprockets are supported along the frame 11 of the system 10. The conventional sprockets are driven via an interconnected main chain 65, by a gear motor, as illustrated.

From their axially aligned positions on the step feeder system 30, the cylindrical items C are moved axially, until they are captured within a part loader assembly 37 of the part loading system 36. As illustrated in FIGS. 10A to 10F and 12A and 12B, the part loader assembly 37 rotates to continuously load parts without the requirement to stop system operation for part loading. The part loader assembly 37 includes a cylindrical wheel 48 with openings 50 positioned surrounding the circumference of the cylindrical wheel for provided stations for capture or engagement of the items C within the wheel 48. Further rotation of the cylindrical wheel 48 moves the parts out of their station within the cylindrical wheel and onto the v-shaped blocks 40 of the conveyor system 38. During rotation, the items may be maintained within the wheel 48 by a cover 49. As the v-shaped blocks are moved in a direction toward the roll coater application system 18, the open end of each cylindrical item supported in the v-shaped block is biased by an inclined ski member, shown in FIGS. 10A-10D, onto a pin assembly station 64 of the transport system 16.

A vision system 52, interconnected with the control system 25 is used to notify the system if parts are feed properly. In the event no parts are feed, a clutch is operated to maintain the wheel in position until parts are provided. An additional clutch mechanism is also provided in the event an item becomes jammed within the wheel 48. The clutch mechanism also operates to maintain the wheel in aligned position with respect to its rotation and position within the system. The drive belt for the part loader assembly 37 is the same as the belt drive for the conveyor system 38 and transport system 16, so the parts C are always provided at the same speed as they are loaded. Additionally, where size and design permit, multiple part items C may be provided to the same slots within the wheel 48 of the part loader assembly 37.

Figure 14A:
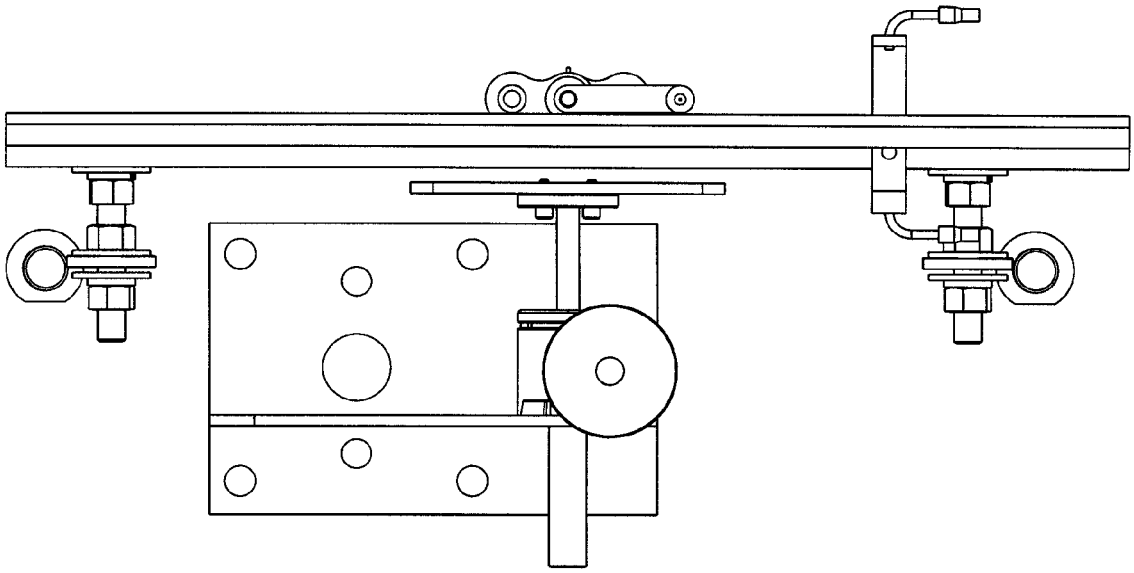
FIGS. 14A and 14B illustrate schematic side views of a pin assembly in both up and down positions for accommodating different sides parts to be manufactured along the lines of the parts shown in FIG. 11.
Figure 14B:
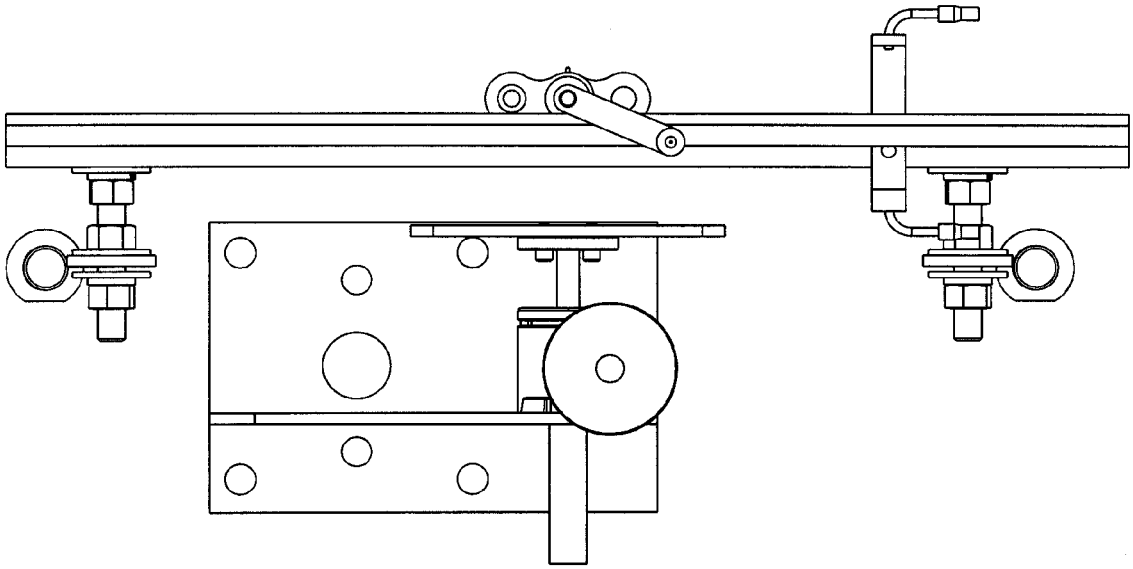
Figure 15A:
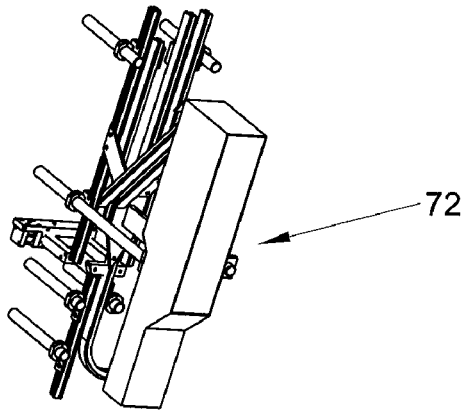
FIGS. 15A to 15C illustrate, respectively, schematic perspective, end and side views of an intermediate part diverter for directing defective parts to the appropriate removal container or conveyor, and allowing acceptable parts to continue being processed.
Figure 15B:
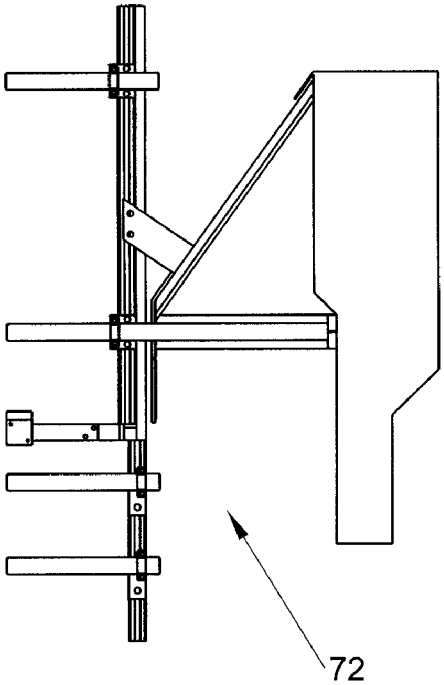
Figure 15C:
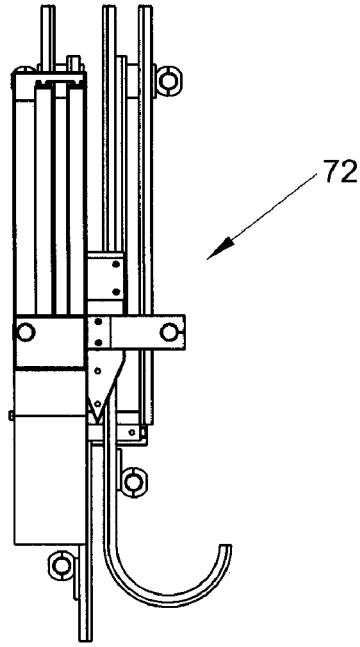

Once located within an opening 50 within the wheel 48 of the part loader assembly 37, the wheel is rotated until the captured item C is moved into the v-shape formed by the v-shaped blocks 40 on the loading system conveyor 36. As the v-shaped blocks are moved in a direction toward the application system 18, the open end E of each cylindrical item C supported in a v-shaped block 40 and into engagement with a pin assembly work station 64, which supports the items on an internal surface. The v-shaped blocks are positioned at a selected height relative to the pins, which height depends on the diameter of the cylindrical items C. As shown in FIGS. 14A and 14B, various positions may be established by the control system 25 to move the pin assemblies and track to the desired height relative to the parts to be processed. Parts having two different diameters are shown engaged with a pin assembly 64 in two different positions in FIG. 11.

In the event a cylindrical item is not properly fed onto its respective pin assembly 64, the system 16 also includes a safety interlock which operates to detect normal operating conditions. In the event pressures exceed normal operating conditions, the spring of the safety interlock is biased out of position and movement of the entire system stops.

Once the cylindrical items C are engaged on the pin assembly work stations 64 of the transport system 16, they are moved into the roll coating application system 18 for application of the coating material M. The roll coating modules or application systems 18 are fully contained within the cabinets previously described and ventilated via the drying and curing systems 11, to reduce fume migration from the material past the walls and covers 28 enclosing the application and curing systems 18, 11.

Figure 13:
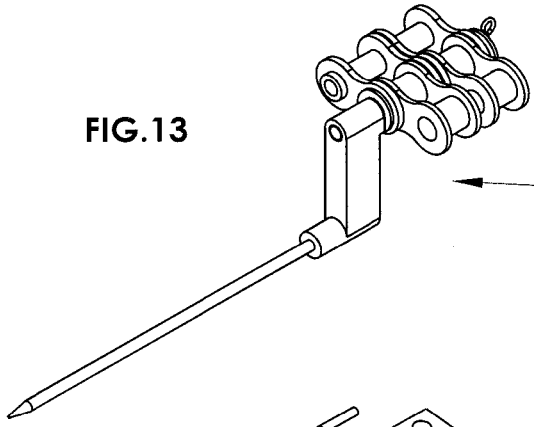
FIG. 13 schematically illustrates a perspective view of a pin assembly which supports items to be manufactured and is mounted on the transport or transfer system.
Figure 12A:
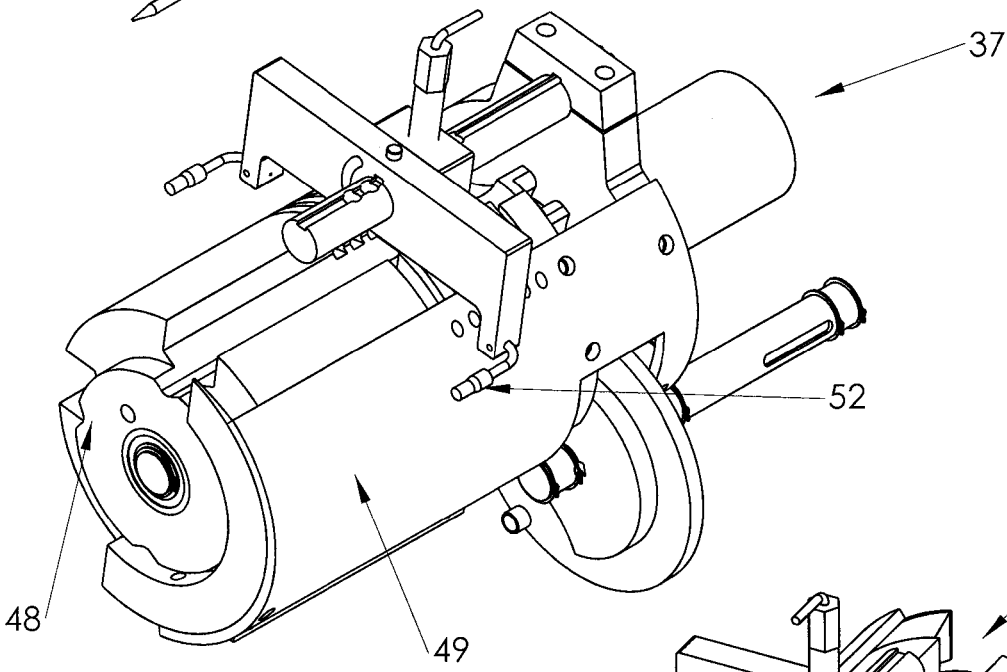
FIGS. 12A and 12B illustrate, respectively, schematic perspective back side and front side views of the part loading assembly.
Figure 12B:
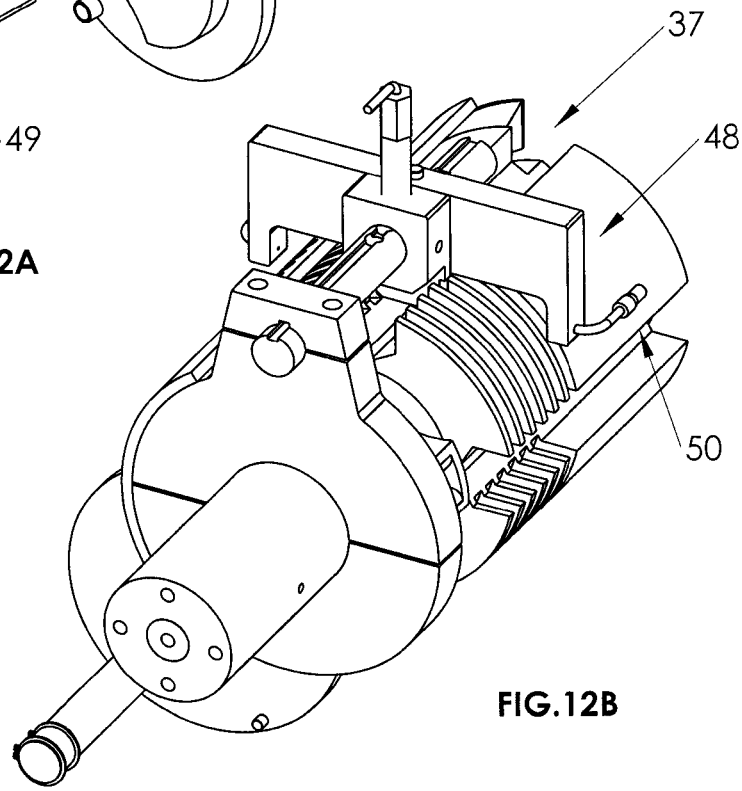

The illustrated pin assembly work stations 64, shown in FIG. 13, of the present embodiment include a pin. One end of the pin is engaged through an opening in a hollow link of the main chain 65. Once the one end 77 of the pin is engaged through the hollow link, a retaining ring is engaged within a groove formed in the one end of the pin. The groove and retaining ring resist removal of the pin from the main chain 65 during operation of the system 10. In the event it is necessary to replace a pin due to wear or other damage, the pin may be readily removed from the link and replaced, once the retaining ring is removed.

The pin assembly work stations 64 and main chain 65 are moved through the part loading system 36 and transport system 16 supported between upper and lower chain guides.

Figure 6:
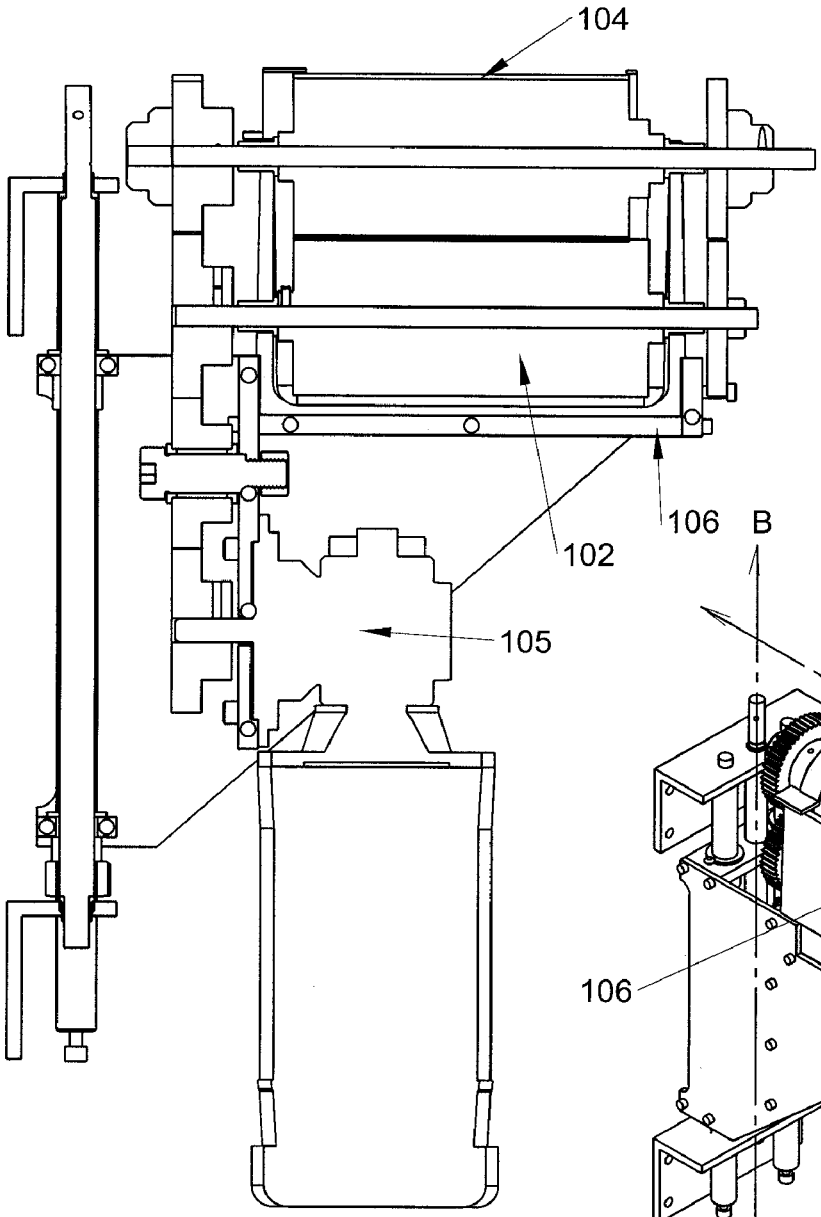
FIG. 6 illustrates a schematic cut-away side view taken along the lines B-B of the roll coating module of FIG. 5.
Figure 5:
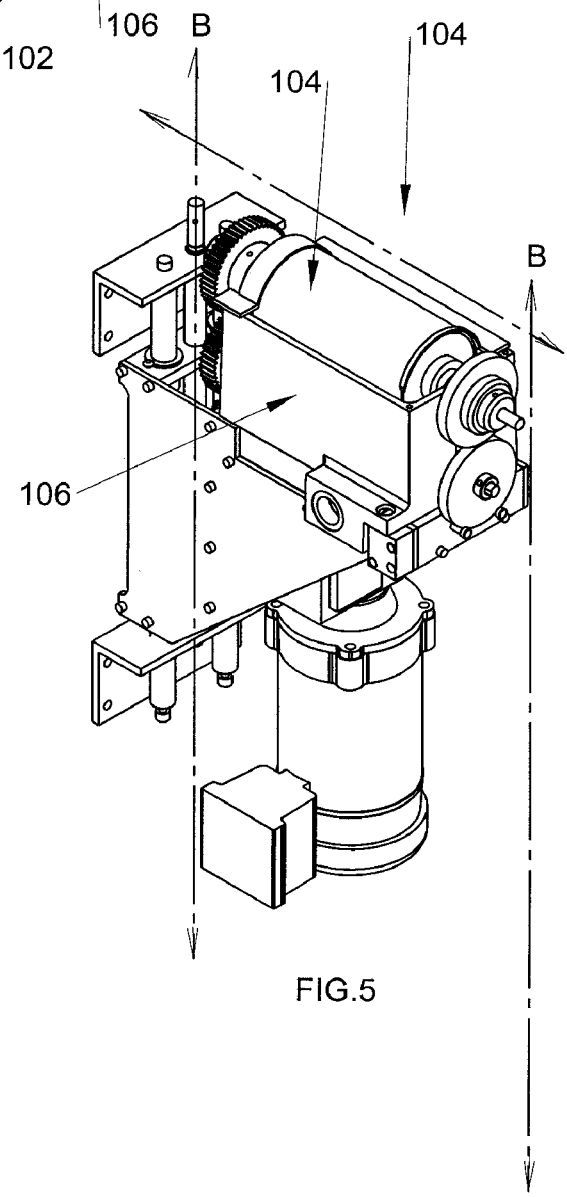
FIG. 5 illustrates a schematic perspective view of a roll coating assembly module.
Figure 8:
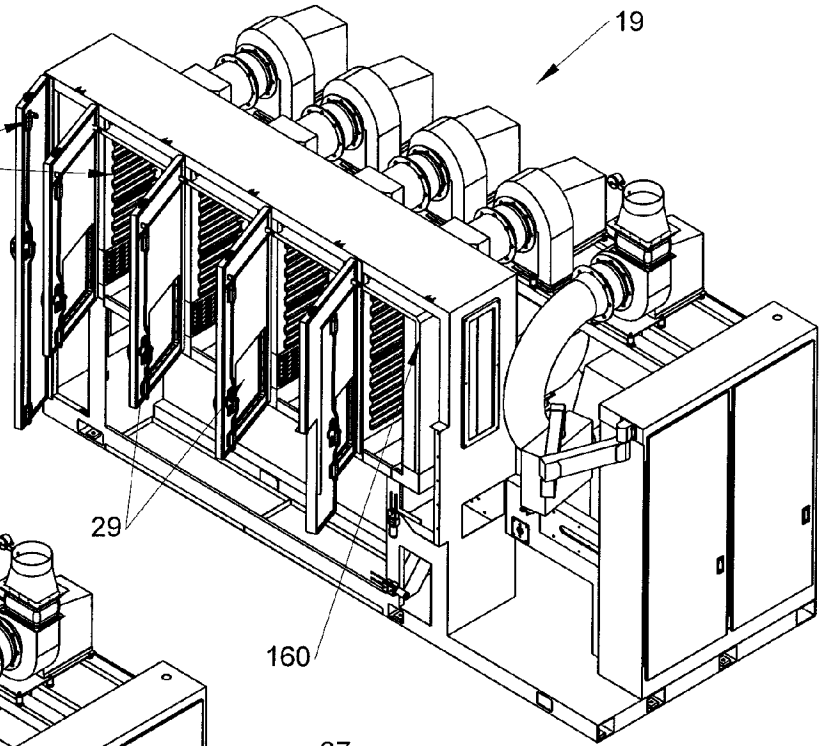
FIG. 8 illustrates a schematic perspective view of the cabinets in open access position.
Figure 7:
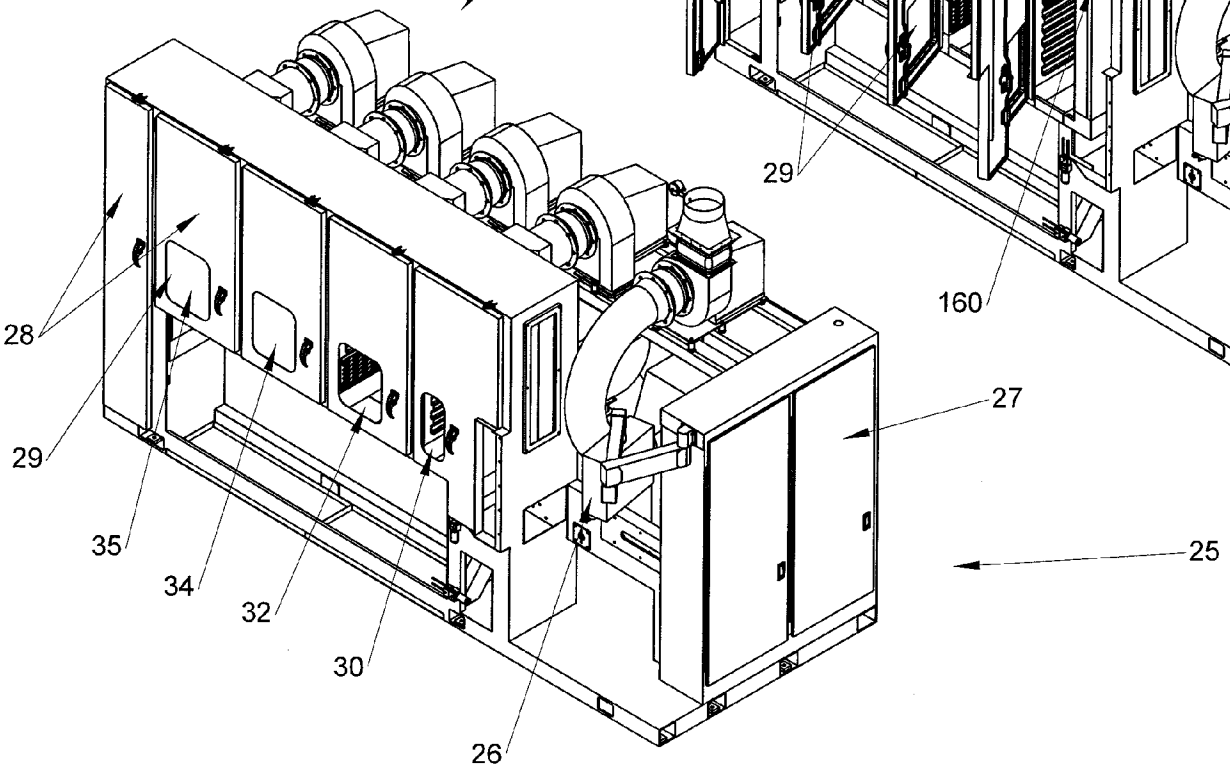
FIG. 7 illustrates a schematic perspective view of the sealed cabinets housing the roll coater applicator and curing systems, and control system.

The roll coater application modules or systems 18 of the system of the present invention are illustrated in FIGS. 5 and 6. The modules 18 are supplied with material to be coated via a material supply system 24, as shown in FIGS. 1, 2 and 4A to 4C. The material supply system 24 includes tanks 111 supported on a movable mounting plate 112. The mounting plate 112 is supported on rollers for ease of movement of the material supply tanks supported thereon. During operation of the application system 18, the tanks 111 may contain any desired material M. The system 10 may include a variety of embodiments of material supply systems as shown by the embodiments of FIGS. 4A, 4B and 4C, 4D.

The roll coating modules 18 each include a doctor roll 102 and a coating roll 104, which are horizontally and axially spaced. The external diameter of the cylindrical items C is engaged with the coating roll 104 to apply material M as the items are moved on the pin assembly work stations 64.

In the embodiment illustrated in FIG. 6, a gear motor 105 turns a gear. This gear engages with an idler gear. The idler gear engages with the doctor roll 102. The doctor roll 102 engages the coating roll 104. This ensures that the doctor roll 102 and coating roll 102 are meshed exactly. No slipping or sliding can occur. This results in a higher quality more consistent coating. The coating roll and doctor roll do not have conventional bearings, but are supported on a central shaft over their reservoirs 106. This eliminates the contamination of conventional bearings and allows both rolls to be lifted out for cleaning without removing any fasteners.

This design also has an extremely small reservoir 106 for fluid. This greatly reduces the amount of coating material exposed to the air. This results in less volatiles being released to the atmosphere and less degradation of the coating material. The small reservoir design results in the coating and doctor rolls serving to mix the coating material. The constant circulation of the material is controlled using a viscosity management system, which monitors the condition of the coating material and supplies material information to the central control system 25. The reservoir 106 is also easily removed for periodic cleaning. It is held in place with 2 quarter turn screws and is lifted out vertically.

The coating roll 104 is preferably covered by a layer of absorbent fabric which engages the external surfaces of the cylindrical items C to apply the material M. It is understood that the surfaces 152, 154 of the coating and doctor rolls may be of any material or configuration, such as grooved or rough, which will hold the material to be applied to the items in the desired thickness.

The amount of material to be applied to the items C is primarily determined by the length of engagement between the cylindrical items C and the coating roll 104, the speed of the transport system 16 and the coating rolls 104, which may all be varied as necessary. By varying the speed of the transport system, the speed of the items at the pin assembly work stations 62 may be increased or decreased as necessary. Additionally, the speed may be increased manually, using the touch screen 26, or, once established, may be automatically controlled by the control system 25 based on the size of the cylindrical item C. The weight of the coating roll 104 is also a factor in determining the thickness of the material. By increasing or decreasing the weight of the coating roll, in the form of the addition or removal of conventional washers mounted on the coating roll shaft, the desired coating roll 104 weight is achieved.

The speed of the application system 18 gear motor 105 may also be varied between 9 rpm and 45 rpm. By varying the speed of the application system 18, the speed at which material is applied to the items C may be increased or decreased as necessary. The application system 18 speed may be increased manually, using the touch screen 26, or, once established, may be automatically controlled by the control system 25. The direction of operation of the system 16, 18, and thus the coating roll 104, may also be varied to obtain the desired engagement time between the rolls and the cylindrical items to apply the material in the desired thickness.

Upon exiting the application system 18 on the pin assembly work stations 64, the cylindrical items having material M applied to the external surface, are moved into the curing system 19. In the illustrated embodiment, the first or primer application system 18 applies primer materials, and the items are then moved to a first or primer curing system 19. Prior to movement to the next station, the parts are visually inspected by the vision system 70 which is incorporated into the system 10 to check for quality control of the coating on the part. If the part is defective a part diverter 72, shown in FIGS. 9A, 9B and FIGS. 15A to 15C, shifts the part to a different process track. On this track, the parts are skied off and out of the system 10. This eliminates additional processing and wasting additional coating material on bad parts. This also insures higher quality since bad parts are not improved by putting additional coats over inadequate base or primer coats.

Upon exiting the primer curing system 19 the items are moved via the transport system 16 to a second, third or final stations 32, 34, 35 of roll coater application modules 18. From the each roll coater system 18, the items are moved to a curing system 19. As set forth above, a single application and curing system, or multiple application and curing systems may be combined, depending on the manufacturing process required. As the features and operation of the first or primer curing system 19 and later application stations are discussed in connection with the first systems 18, 19, no further discussion of these systems is required.

The illustrated curing system 19 includes a drying chamber 160 behind and within the sealed doors 28 which dries the material M on the items C within the transport system 16. The drying chamber includes a ventilation system 162 which provides ambient air into the chamber 160, and an exhaust system 164 which is used to discharge air and material fumes from the chamber. As shown in FIGS. 1A and 1B, the drying chambers 160 are formed by the frame 11, enclosed by Tempered Glass walls and covers 28.

The transport system 16 moves the pin assembly work stations 64 through the drying chamber 160 via the main chain 65. The chain 65 is engaged over corner sprockets mounted within the chamber 160 on vertical support members of the frame 11. The system 10 is designed to install additional chain within the cure ovens for water based adhesives.

The ventilation system 162 introduces ambient air into the drying chamber 160 via a fan assemblies located behind the drying chambers 160. The exhaust system 164 removes air and fumes from the drying chamber 160 via a fan assembly. The fan assembly of the exhaust system 164 pulls the exiting air in an upward direction through the chamber. During operation of the exhaust fan assembly 178, a negative pressure area is created adjacent the associated application system 18 to remove interfering fumes from the application system 18 via the exhaust system 164. By maintaining and controlling operation of the ventilation system fan assembly and the exhaust system fan assembly, the air flow through the drying chamber and over the cylindrical items may be controlled to dry the items at the desired rate.

Control of the exhaust system 164 additionally enables control of any environmental exhaust requirements by establishing the rate of exhaust exiting the drying chamber using the fan assembly. To ensure that the proper exhaust requirements are maintained, an air flow safety sensor is provided in connection with the fan assembly. The air flow sensor is electrically interconnected between the fan assembly and the control system 25. In the event the operation of the fan assembly is less than that necessary to maintain environmental exhaust requirements, operation of the system 10 shuts off. By interconnecting satisfactory operation of the exhaust fan assembly with operation of the system 10, no build up of exhaust fumes is permitted within the system. Manual operation of the fan assembly is also provided via the touch screen 26.

Figure 16:
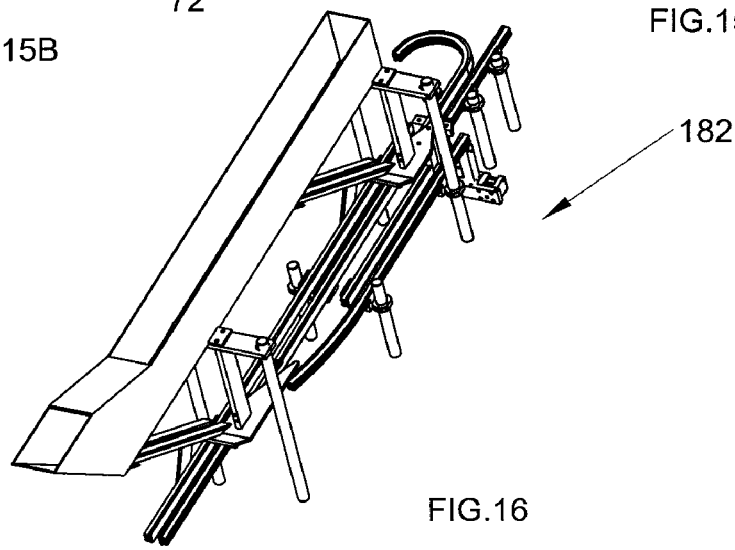
FIGS. 16A to 16C illustrate, respectively, schematic perspective, front and side views of a final part diverter for directing defective parts and completed parts to their respective appropriate removal container or conveyors.

Once the cylindrical items are cured within the drying chamber 160 they are removed from their pin assembly work stations 64 on the transport system 16 by a final part diverter 182. As illustrated in FIGS. 16A to 16C, final part diverter 182 has two discharge lanes to provide a dwell or buffer in the output of the system to allow for finished part container change. This is accomplished by switching the parts skied off to a second track. On this second track the ski is placed at a later distance than the earlier ski. This distance provides the dwell in which to change finished part containers. When the totes or removal containers 62 are changed the discharge switches back to the first ski so that the dwell can be used for the next tote change. When this occurs parts are falling off of both skis at the same time.

Upon exiting the final part diverter 182, the cured cylindrical items C are deposited to the finished part conveyor or take-away system 22 using the removal containers 62 described above. The take-away 22 may be used to transfer the items to a still further or final processing station. Alternatively, the items may be provided to a next or final process station via a conveyor system.

Accordingly, a system for applying material to cylindrical items C has been described above which may be manually or automatically controlled. In the illustrated embodiment, the operating parameters, such as speeds and heights, of the part supply system 14, transport system 16, application systems 18, and curing systems 19, are programmed into the central control system 25. The desired operating parameters for the systems are determined experimentally depending on the size of the cylindrical item C and the material M to be applied. Once the desired parameters are established, they are entered into the control system 25 for the various items and materials to be applied. Once the parameters are programmed into the control system 25, the systems of the system 10 may be readily and automatically changed to apply the desired material to the desired items by entering the name of the desired cylindrical items and materials to be manufactured into the using the touch screen 26. Upon receiving instructions concerning the items and materials to be manufactured, the control system then adjusts the necessary operating settings of the various systems to produce the desired result.

The preferred form of the system 10 has been described above. However, with the present disclosure in mind it is believed that obvious alterations to the preferred embodiment, to achieve comparable features and advantages in other systems, will become apparent to those of ordinary skill in the art.

We claim:

1. A manufacturing assembly system for application of a material to the external diameter of cylindrical items, the system comprising a controller, a frame, a transport system, a material supply system, an application system, and a curing system for curing the material applied to cylindrical items, and the application system, the curing system, and a portion of the transport system, are enclosed to prevent migration of material fumes from the system, the controller comprising a preprogrammed computer for automatically controlling the application of material to the items and movement of the items through the transport, application and curing systems depending on the materials being applied, the frame for supporting the transport system, the transport system comprising a continuous conveyor having a plurality of work stations movably supporting and transporting cylindrical items to the application system and curing system, the material supply system positioned and supported for movement into and out of sealed engagement with the enclosure provided for the application system, the curing system and a portion of the transport system, the application system comprising first and second horizontally, axially spaced application rolls, each of which is engagable with the external diameter of one or more cylindrical items when the items are supported at one of the work stations to apply the desired material, and a reservoir system having a material tank with material for engagement with the application rolls during engagement of the rolls with the cylindrical items, the cylindrical items being provided to the work stations via a part loading system comprising a continuous conveyor, the conveyors of the transport and loading systems having a single drive mechanism which operates both of the conveyors, such that the cylindrical items are provided to circumferentially located stations within and surrounding a cylindrical wheel of the part loading system which rotates to engage and move the cylindrical items into and out of the stations of the cylindrical wheel about a central axis of the cylindrical wheel and into the transport system conveyor by movement of the drive mechanism and respective conveyor synchronized by the controller.

2. The system of claim 1 wherein the part loading system includes a vision system for confirming positive location and alignment of the cylindrical items within the cylindrical wheel.

3. The system of claim 2, wherein clutch mechanisms are provided within the cylindrical wheel of the part loading system which operates to stop rotation of the cylindrical wheel upon notification from the vision system or upon improper part loading.

4. The system of claim 1, wherein processing of the items within the system is conducted within an enclosed environment for supporting a negative pressure.

5. The system of claim 1, wherein a vision system is provided to accept or reject completed parts based upon a visual quality inspection.

6. The system of claim 5, wherein detection of a defective part by said vision system activates operation of a part diverter which physically engages the defective part to remove the defective part from the system.

* * * * *